United States Patent [19]

Crockett

[11] Patent Number: 4,850,645

[45] Date of Patent: Jul. 25, 1989

[54] LIFTING APPARATUS FOR A SEATING STRUCTURE

[76] Inventor: Foy Crockett, Rt. 1, Box 193, Hugo, Okla. 74743

[21] Appl. No.: 241,692

[22] Filed: Sep. 7, 1988

Related U.S. Application Data

[63] Continuation-in-part of Ser. No. 927,815, Nov. 6, 1986, Pat. No. 4,786,107.

[51] Int. Cl.[4] ..... A47C 1/02

[52] U.S. Cl. ..... 297/330; 297/347; 297/DIG. 10

[58] Field of Search ..... 297/DIG. 10, 330, 347

[56] References Cited

U.S. PATENT DOCUMENTS

| | | | |
|---|---|---|---|
| 2,821,242 | 1/1958 | Manegold | 248/421 |
| 3,123,400 | 3/1964 | Paulson | 297/314 |
| 3,138,402 | 6/1964 | Heyl, Jr. et al. | 297/69 |
| 3,472,488 | 10/1969 | Naughton | 254/122 |
| 3,596,982 | 8/1971 | Grams | 297/71 |
| 3,865,347 | 2/1975 | Pase | 254/124 |
| 3,894,303 | 7/1975 | Angel | 297/DIG. 10 |
| 4,083,599 | 4/1978 | Gaffney | 297/131 |
| 4,448,382 | 5/1984 | Melone | 248/421 |
| 4,752,100 | 6/1988 | Lemaire | 297/330 X |

FOREIGN PATENT DOCUMENTS

| | | | |
|---|---|---|---|
| 600834 | 6/1978 | Switzerland | 297/DIG. 10 |
| 2161371 | 1/1986 | United Kingdom | 297/DIG. 10 |

OTHER PUBLICATIONS

Sales brochure No. PPA-383 Entitled "Performance PAK Actuator" by Thomson Saginaw Ball Screw Company, Inc., Dated 3/87, pp. 4 and 5.

*Primary Examiner*—James T. McCall

*Attorney, Agent, or Firm*—Laney, Dougherty, Hessin & Beavers

[57] ABSTRACT

An apparatus for elevating and lowering a freestanding seating structure, such as a house chair, recliner, or sofa. The apparatus is comprised of a base, an elevator assembly, a power assembly connected between the base and the elevator assembly, and a control assembly. The elevator assembly releasably receives, supports, elevates and lowers the seating structure. The power assembly provides power and supportingly moves the elevator assembly. The control assembly controls the power assembly and the position of the elevator assembly relative to the base. The invention also includes riser arms which are pivotally connected between the base and the elevator assembly for structurally supporting the stabilizing the elevator assembly.

7 Claims, 9 Drawing Sheets

LIFTING APPARATUS FOR A SEATING STRUCTURE

CROSS REFERENCE TO RELATED APPLICATIONS

This application is a continuation-in-part of application Ser. No. 927,815 which was filed on Nov. 6, 1986 now Pat. No. 4,786,107.

BACKGROUND OF THE INVENTION

This invention relates to lifting apparatus and more particularly relates to a lifting apparatus which may be used to elevate and lower chairs and furniture.

Elevatable chairs have been known in the art for quite some time, as have elevators and powered lifting devices. For example dentist's chairs, barber's and beautician's chairs, elevatable invalid's chairs, and building elevators have been in common use for many years.

A shortcoming in the elevatable chairs and lifting devices known in the art is that a person can not attach a conventional chair to the known lifting devices for everyday home use. For example, partially disabled persons who can not lower or raise themselves from a conventional chair have no lifting device available which will adapt to their favorite conventional chair and must purchase an expensive integral chair and lifting device assembly.

SUMMARY OF THE INVENTION

Accordingly, it is an advantage of this invention to provide a relatively inexpensive lifting apparatus which can be releasably attached to and used to lift and lower conventional seating structures, such as chairs, sofas, recliners, etc.

The lifting apparatus of the present invention includes a base, and elevator means, power means, and control means. The elevator means is used for releasably receiving, supporting, elevating, and lowering an entire freestanding structure of a house chair, recliner, sofa, etc. The power means is connected between the base and the elevator means and is used for providing power and for supportingly moving the elevator means between a lowered position and an elevated position relative to the base. The control means is used for controlling the power means and the position of the elevator means relative to the base.

The lifting apparatus may also include riser arm means which are pivotally engaged between the base and the elevator means. The riser arm means cooperate with the power means to support and lift the elevator means. The riser arm means lift the rear of the elevator means more than the front of the elevator means as the elevator means is lifted in order to allow easy access to a chair on the elevator means.

BRIEF DESCRIPTION OF THE DRAWINGS

The present invention will be better understood by reference to the examples of the following drawings.

DETAILED DESCRIPTION OF THE PREFERRED EMBODIMENTS

Before explaining the present invention in detail, it is to be understood that the invention is not limited to the details of construction and arrangement of parts illustrated in the accompanying drawings, since the invention is capable of other embodiments and of being practiced or carried in various ways commensurate with the claims herein. Also, it is to be understood that the terminology employed herein is for the purpose of description and not of limitation.

Figure 1:
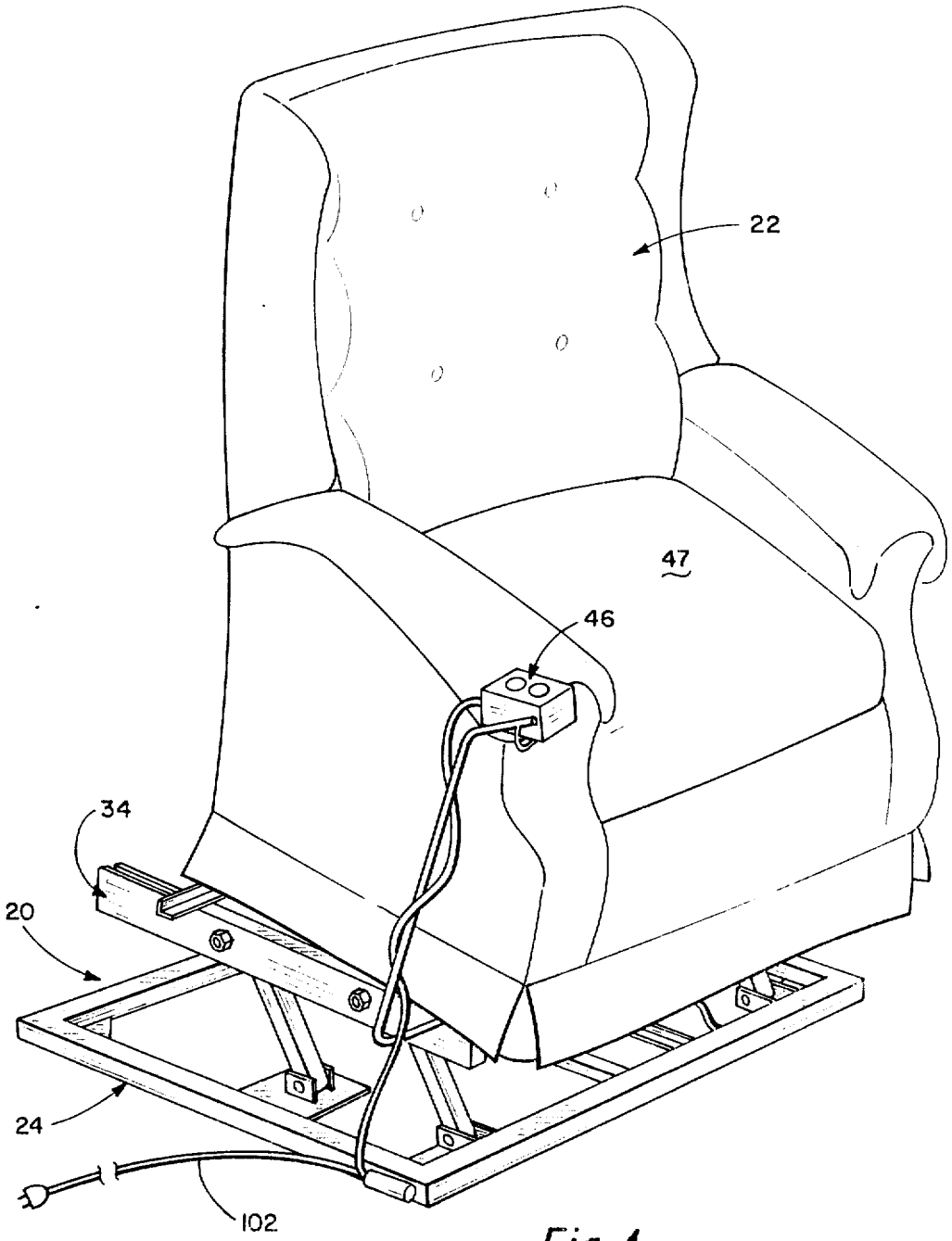
FIG. 1 is a perspective view of an embodiment of the lift apparatus of the present invention with a rocking chair releasably attached thereto.

FIG. 1 presents one embodiment of a lift apparatus, generally designated 20, for elevating and lowering a seating structure 22 such as a house chair, recliner, sofa, etc. Referring also to the example of FIG. 2, it is seen that the lift apparatus 20 may be described as being generally comprised of a base, generally designated 24, having a front 26, a rear 28, and two sides 30, 32; an elevator means, generally designated 34, having a front 36, rear 38, and two sides 40, 42 which are oriented in correspondence with the like-named features of the base 24; a power means, generally designated 44; and control means 46 (best seen in FIG. 1).

The elevator means 34 is used for releasably receiving, supporting, elevating, and lowering an entire freestanding seating structure 22, such as a house chair, recliner, sofa, or any similar piece of furniture. The elevator means 34 is primarily intended to releasably receive the understructure or legs of a freestanding seating structure 22 which "freestands" on a planar surface, such as a floor, with the understructure supporting the seating surface 47 of the structure 22 in a position spaced away from the floor. The seating structure 22 illustrated in FIG. 1 is a rocking chair and is depicted in a "rocked forward" position to reveal as much as possible of the lift apparatus 20. The lift apparatus 20 and elevator means 34 may be easily modified to accept virtually any size furniture by simply increasing or decreasing the size and/or strength of the lift apparatus 20 and power means 44.

Figure 2:
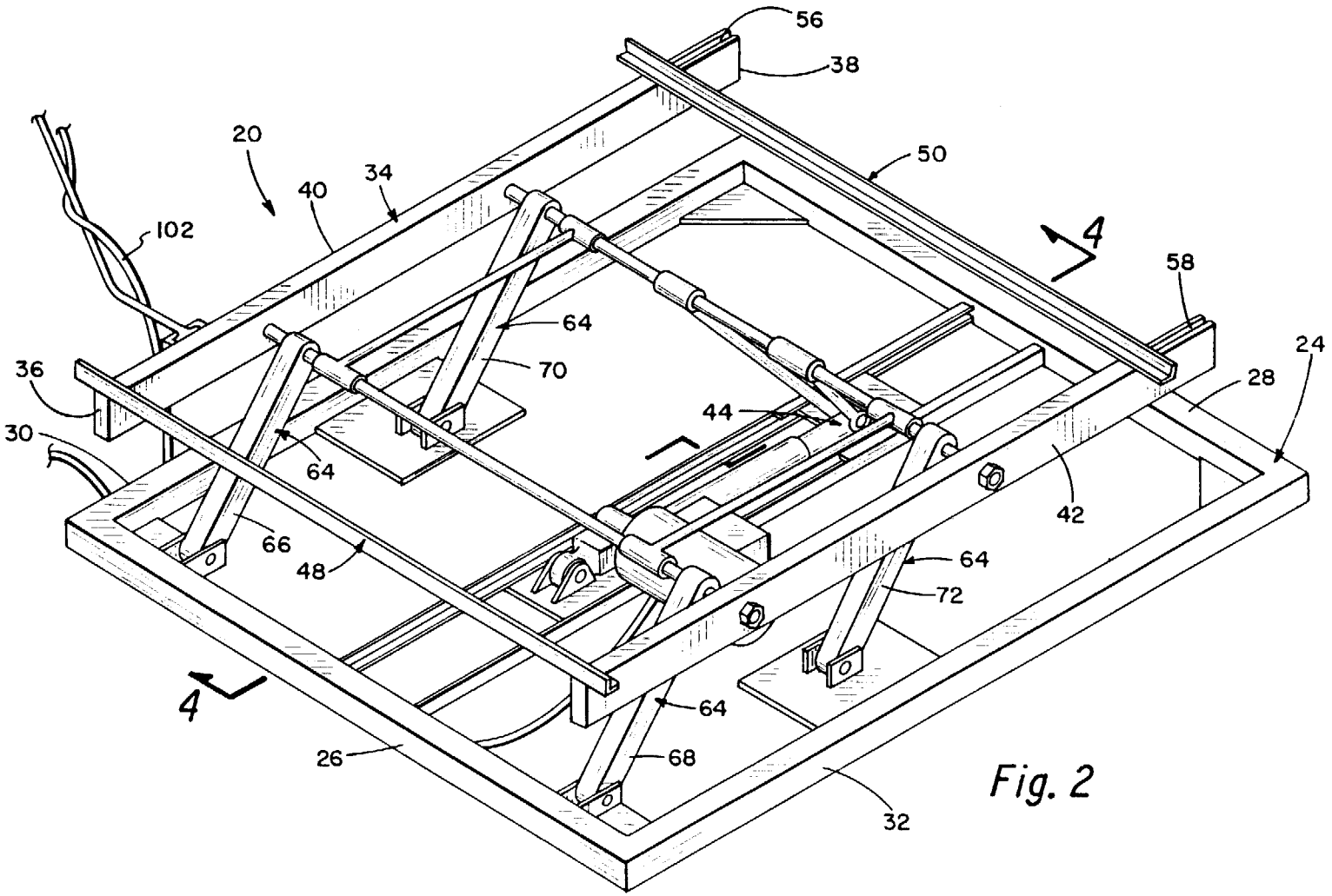
FIG. 2 is a perspective view of an embodiment of the lift apparatus of the present invention.

Referring to example FIG. 2, the elevator means 34 may further include attachment means 48, 50 for releasably securing the seating structure 22 to the elevator means 34. As exemplified in FIG. 2, the attachment means 48, 50 may be as simple as a front bracket (also designated 48) and rear bracket (also designated 50) which receive the feet or base of the seating structure 22. The rear bracket 50 slides in the slots 56, 58 in order to adjust to accommodate various sizes of furniture or seating structures 22. Referring to example FIG. 3, bolts 60, 62 are provided to secure the rear bracket 50 in position and thereby to secure the seating structure 22 to the lift apparatus 20 once the rear bracket has been adjusted to fit the seating structure. The bolts 60, 62 may be replaced with spring loaded pins, mechanical pins, or equivalent mechanical fasteners. The attachment means 48, 50 may be replaced with clips, straps, bands, bolts, screws, etc. to accommodate a particular seating structure's 22 or user's requirements.

The attachment means 48, 50 of the example embodiment may also serve to properly orient the seating structure 22. As seen in FIG. 2, the front bracket 48 of the attachment means 48, 50 may be located at the front edge 36 of the elevator means 34 in order to allow the seating structure 22 to be positioned as far forward on the lift apparatus 20 as possible and to allow entry or access to the seating structure 22 with as little obstruction by the lift apparatus 20 as possible.

Figure 6:
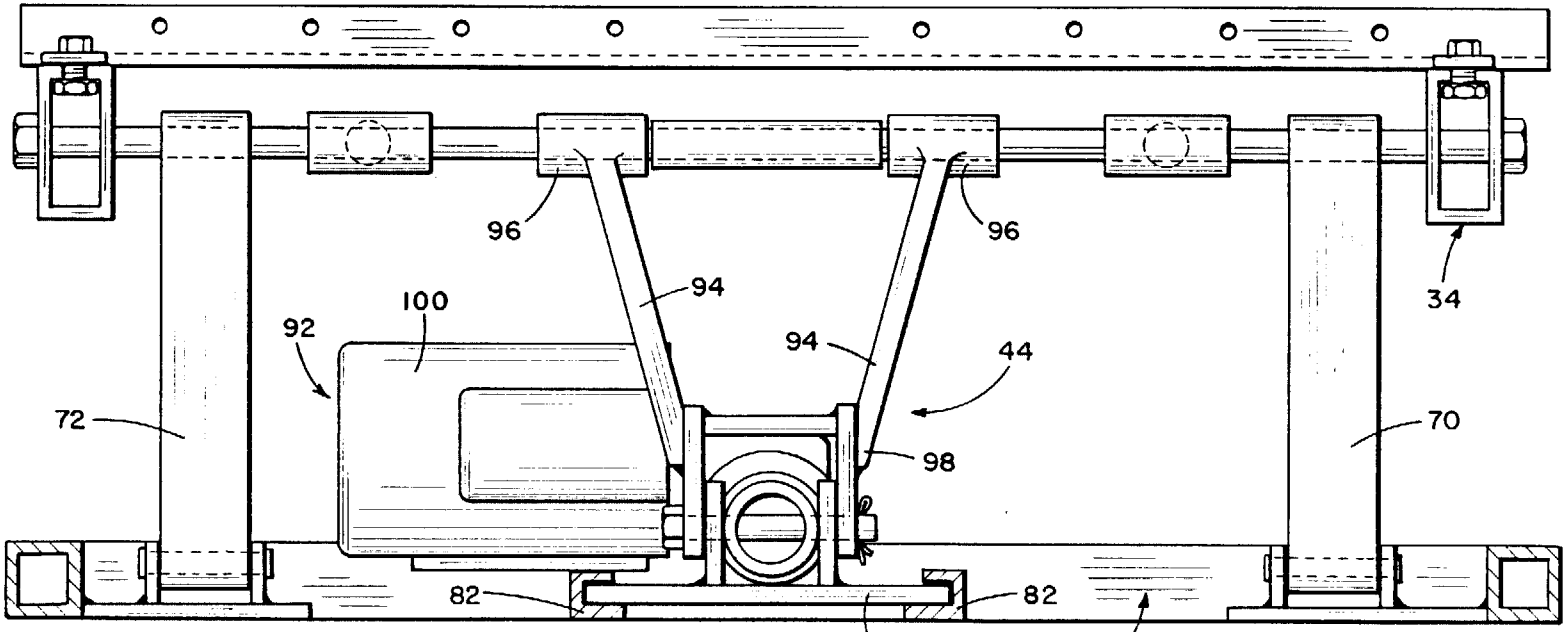
FIG. 6 a sectional view taken along line 6—6 of FIG. 4.

As best seen in FIG. 6, the power means 44 is connected between the base 24 and the elevator means 34 for supportingly moving the elevator means 34 between a lowered position and an elevated position relative to the base 24. The power means 44 may comprise any form of electrically, pneumatically, or hydraulically powered lifting mechanism which will structurally support as well as elevate and lower the elevator means 34 and seating structure 22.

The control means 46 is used for controlling the power provided by the power means 44 and for controlling the position of the elevator means 34 relative to the base 24.

Figure 4:
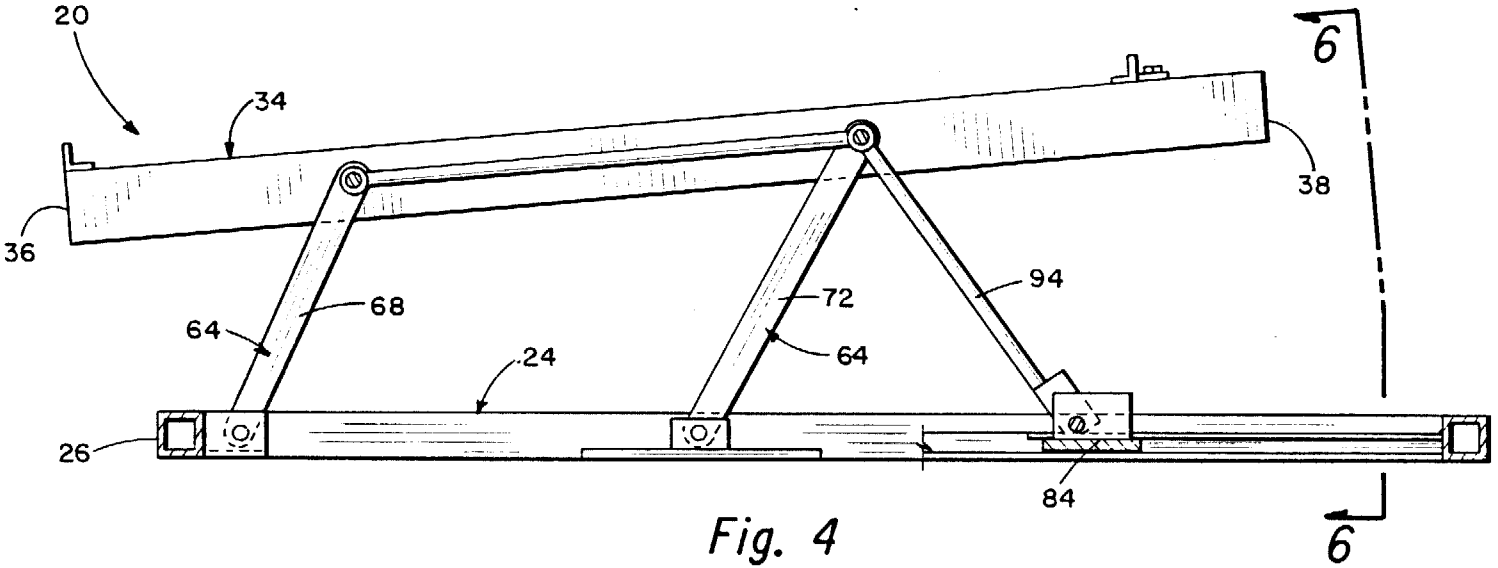
FIG. 4 is a sectional view along line 4—4 of FIG. 2.
Figure 5:
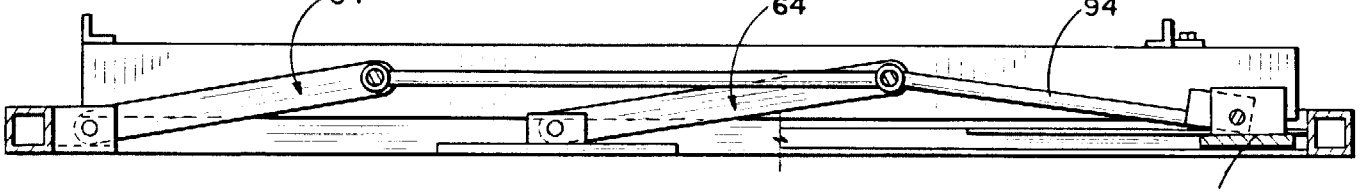
FIG. 5 is a sectional view taken along line 5—5 of FIG. 3.

Referring to FIGS. 4 and 5, in the example embodiment the lift apparatus 20 may also include riser arm means 64 having one end pivotally engaged with the base 24 and the other end pivotally engaged with the elevator means 34 for structurally supporting and stabilizing the elevator means 34 and for distributing the forces of the elevator means 34 on the base 24. The pivotal engagement of the riser arm means 64 with the base 24 and the elevator means 34 are oriented such that the riser arm means 64 pivots to form a smaller angle with the plane of the base 24 as the elevator means 34 is lowered (best seen in FIG. 5) and the riser arm means 64 pivots to form a larger angle with the plane of the base 24 as the elevator means 34 is elevated (best seen in FIG. 4). Also, as illustrated in the example embodiment of FIG. 4, riser arm means 64 pivots towards the front 36 of the elevator means 34 and the front 26 of the base 24 as the elevator means 34 is elevated, thereby moving the elevator means 34 towards the front of the base as the elevator means is elevated. This feature makes the use of the lift apparatus more comfortable, that is, the forward motion of the elevated elevator means moves the seating structure 22 over the front 26 of the base 24 and minimizes the obstruction the base presents to a person entering or exiting the elevated seating structure 22. In a more preferred embodiment, referring to the example of FIG. 7, the riser arm means 64 pivot towards the rear 38 of the elevator means 34 and the rear 28 of the base 24 as the elevator means 34 is elevated. The riser arm means 64 are connected between the elevator means 34 and the base 24 in such a manner that the rearward pivoting of the riser arm means 64 positions the elevator means 34 to minimize the obstruction the base 24 presents to a person entering or exiting the elevated seating structure 22, as further discussed infra.

Figure 7:
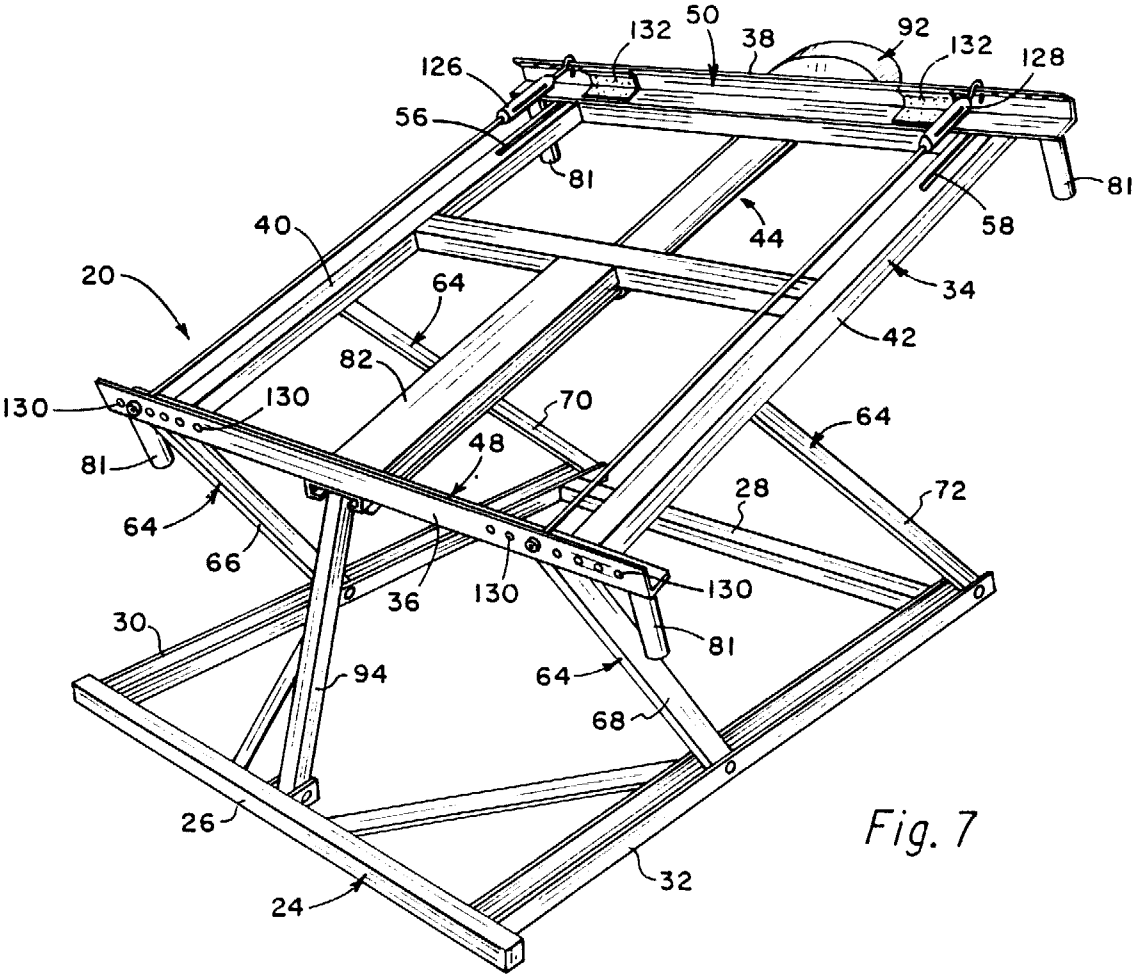
FIG. 7 is a perspective view of a more preferred embodiment of the lift apparatus of the present invention.
Figure 8:
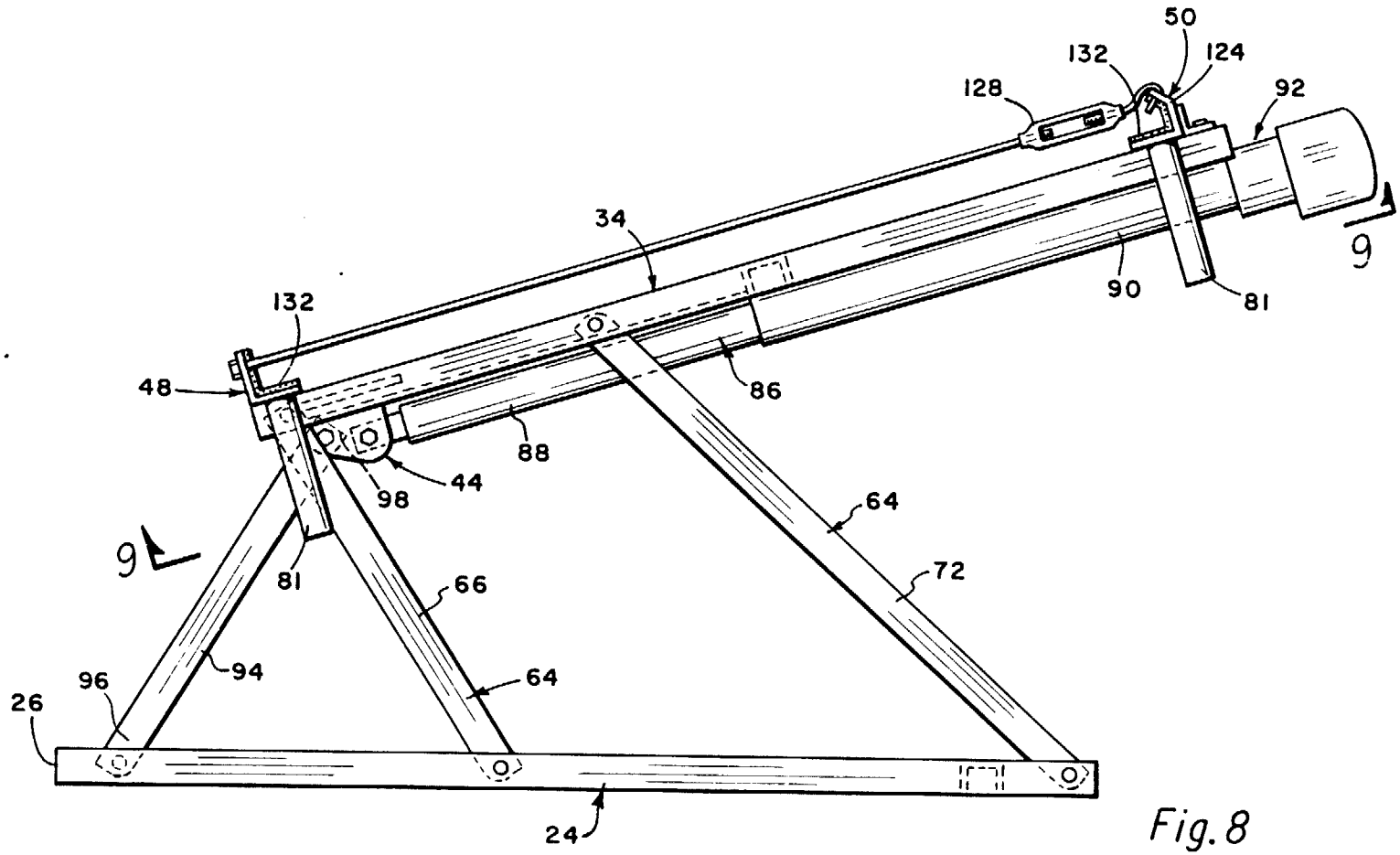
FIG. 8 is a side view of the embodiment of FIG. 7 with the lift apparatus being in the elevated position.

In order to provide good structural support and stability for the elevator means 34, in the example embodiment, as illustrated in FIGS. 2 and 6, the riser arm means 64 comprises four riser arms, 66, 68, 70, 72 with two of the riser arms being positioned near each side of the elevator means 26. Although adequate structural support and stability may be provided with two riser arms, one of the two riser arms being positioned near each side 40, 42 of the elevator means 34, by providing four riser arms 66, 68, 70, 72 with two of the riser arms 66, 68, 70, 72 positioned near each side 30, 32 of the base 24 and elevator means 34 and making the two riser arms 70, 72 nearest the rear 38 of the elevator means 34 longer than the two riser arms 66, 68 nearest the front 36 of the elevator means 34 the rear 38 of the elevator means 34 is elevated more than the front 36 of the elevator means 34 as the elevator means is elevated (best seen in FIGS. 4 and 8). This feature tilts the elevated elevator means 34 and seating structure 22 towards the front of the lift apparatus 20, as illustrated in FIGS. 1, 4, and 8, which makes the elevated seating structure 22 easier to enter and exit, particularly by a partially disabled person. In the example of FIGS. 2 and 7, the four riser arms 66, 68, 70, 72 are positioned to define the four corners of a rectangle, although this is not essential to the operation of the lift apparatus 20, i.e., the riser arms 66, 68, 70, 72 may be positioned as required or desired for a specific application and the length of the arms may be adjusted to achieve the desired elevation and angle or tilt of the elevator means 34. In the preferred embodiment of FIGS. 7 and 10, the elevator means is three inches from the floor in the lowered position, the front 36 of the elevator means 34 is twelve inches from the floor in the elevated position, and the elevator means is tilted at an angle of about 17° with respect to the plane of the base 24 in the elevated position.

Figure 3:
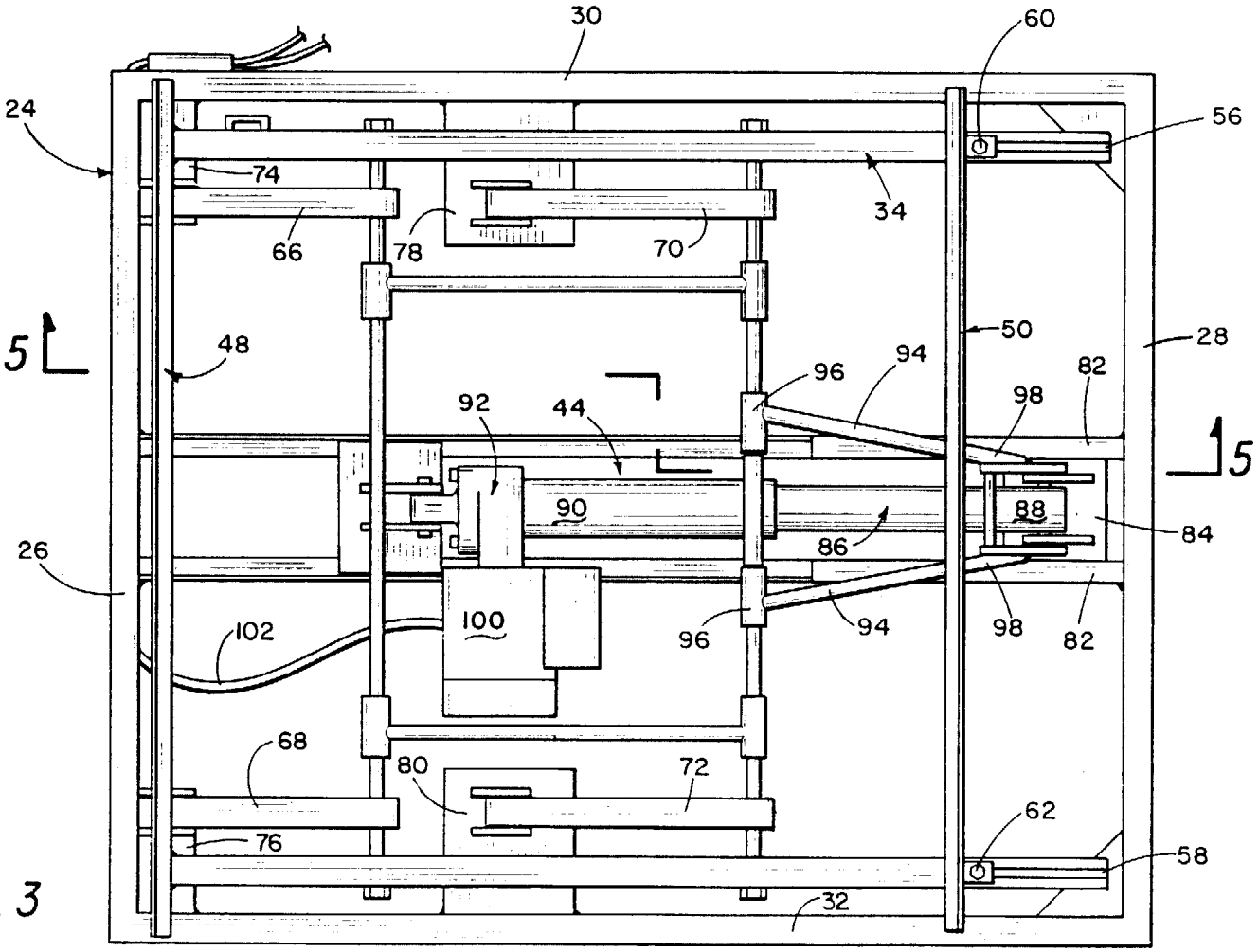
FIG. 3 is a plan view of the embodiment of FIG. 1 with the lift apparatus being in the lowered position.

Referring to example FIG. 3, the riser arms 66, 68, 70, 72 and the elevator means 34 are inset within the perimeter defined by the front 26, rear 28, and sides 30, 32 of the base 24. Also, the riser arms 66, 68, 70, 72 are pivoted at their lower ends from pivot plates 74, 76, 78, 80 within the plane of the base 24. This allows the elevator means 34 to retract within the plane of the base 24 in the lowered position of the elevator means 34 (best seen in FIG. 5). This feature minimizes the effect of the lowered lift apparatus 20 on the height of the seating structure 22.

Figure 9:
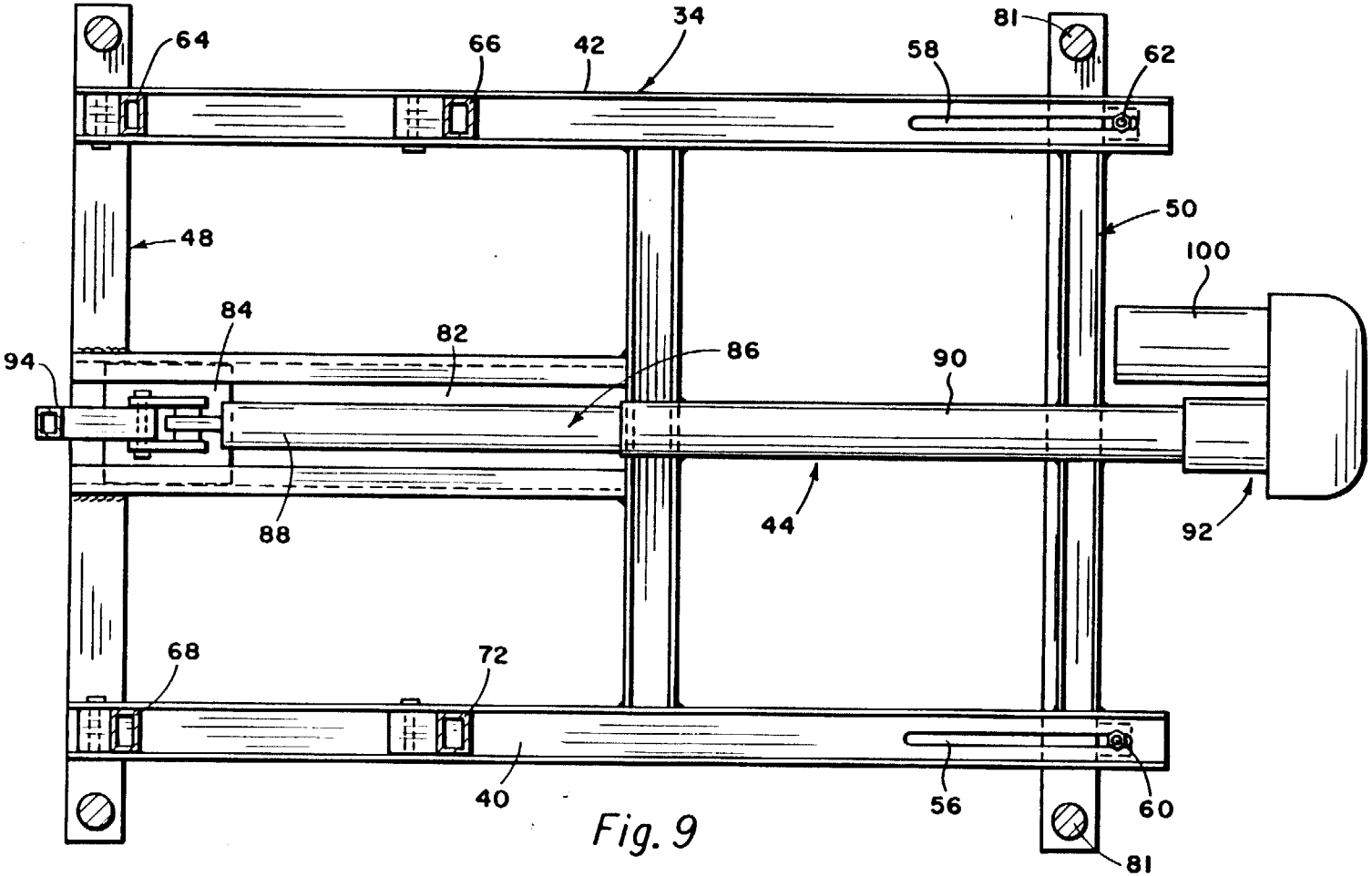
FIG. 9 a sectional view taken along line 9—9 of FIG. 8.

In the more preferred embodiment, referring to the example of FIGS. 7 and 9, the sides 40, 42 of the elevator means 34 and the sides 30, 32 of the base 24 are made of channel-shaped members. The lower ends of riser arms 66, 68, 70, 72 are pivotally connected within the channel of sides 30, 32 and the upper ends of riser arms 66, 68, 70, 72 are pivotally connected within the channel of sides 40, 42. The connection of the ends of the riser arms 66, 68, 70, 72 within the channels of sides 30, 32, 40, 42 strengthens and stabilizes the riser arms 30, 32, 40, 42 and eliminates the need for pivot plates 74, 76, 78, 80. The riser arms 66, 68, 70, 72 retract partially within the channels of sides 30, 32, 40, 42 as the lift apparatus 20 is lowered to minimize the effect of the lowered lift apparatus 20 on the seating structure 22, as exemplified in FIG. 10.

Figure 10:
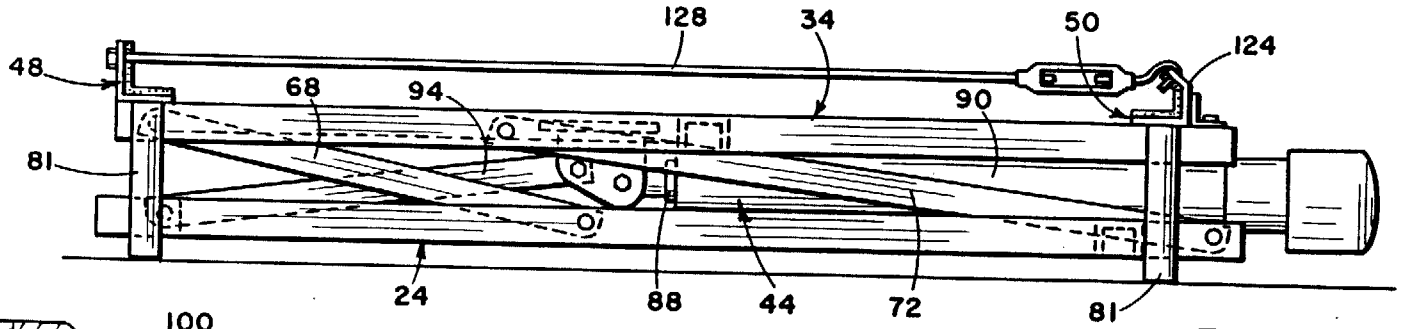
FIG. 10 is a side view of the embodiment of FIG. 8 with the lift apparatus being in the lowered position.

In the more preferred embodiment of example FIGS. 7-10, legs 81 are provided at each corner of the elevator means 34. The legs 81 increase the stability of the lift apparatus 20 in the lowered position. Legs 81 also relieve the power means 44 by unloading it. Legs 81 are sized to contact the floor, or other surface upon which the base 24 rests, slightly before the elevator means 34 reaches the fully lowered position. In the example of FIG. 10, the legs 81 contact the floor 81 approximately one-eighth inch before the elevator means 34 is fully lowered. The power means 44 continues to run after the legs 81 contact the floor which lifts the base 24 slightly off the floor and shifts the weight of the elevator means 34 and seating structure 22 from the power means 44 and riser arm means 64, or riser arms 66, 68, 70, 72 to the legs 81.

Referring to example FIGS. 3 and 6, the power means 44 may comprise'a slideway 82 secured to the base 24; a slide 84 slidingly engaging the slideway 82; a ram 86 having a first end 88 pivotally engaged with the slide 84 and having a second end 90; a power source means, generally designated 92, engaged with the second end 90 of the ram 86, for drivingly extending and retracting the ram 86 and slide 84; and at least one lifting arm 94, having a first end 96 pivotally engaged with the elevator means 34 and a second end 98 pivotally engaged with the slide 84. The lifting arm 94 pivots to form a smaller angle with the base 24 as the ram 86 and slide 84 are extended thereby lowering the elevator means 34 (best seen in FIG. 5). The lifting arm 94 pivots to form a larger angle with the base 24 as the ram 86 and slide 84 are retracted, thereby elevating the elevator means 34 (best seen in FIG. 4).

In the more preferred embodiment of example FIGS. 7–10, slideway 82 is secured to the elevator means 34 with slide 84 slidingly engaging the slideway 82. The ram 86 has first end 88 pivotally engaged with slide 84, and second end 90 engaged with power source means 92. Power source means 92 drivingly extends and retracts ram 86 and slide 84. Lifting arm 94 has first end 96 pivotally engaged with base 24 and second end 98 pivotally engaged with slide 84. The lifting arm 94 pivots to form a larger angle with the plane of base 24 as the ram 86 and slide 84 are extended, thereby elevating the elevator means 34 (best seen in FIG. 8). The lifting arm 94 pivots to form a smaller angle with the plane of base 24 as the ram 86 and slide 84 are retracted, thereby lowering the elevator means 34 (best seen in FIG. 10).

Referring to FIGS. 4, 5, 8, and 10, the lifting arm 94 transposes the horizontal sliding force imparted to the slide 84 by the power source means 92 into a vertical motion which pivotally lifts or lowers the elevator means 34 about the pivotal engagement of the riser arms 66, 68, 70, 72 with the base 24 and elevator means 34. This transposition of motion is facilitated by the relative orientations of the lifting arm 94 and riser arm means 64, i.e., the axes about which the lifting arm 94 and riser arms 66, 68, 70, 72 pivot are parallel and the longitudinally axial plane of the lifting arm 94, the longitudinally axial plane of the riser arm means 52 or any one of the riser arms 66, 68, 70, 72, and the plane of the base 24 form a triangle. These relative orientations, together with the longer length of the two riser arms 70, 72 nearest the rear of the elevator means 34 place the elevator means 34 in a plane generally parallel with the plane of the base 24 in the lowest elevation of the elevator means 34 and also elevate the rear 38 of the elevator means more than the front 36 of the elevator means as the elevator means is elevated.

In the more preferred embodiment of FIGS. 7 and 10, the lower ends of the front riser arms 66, 68 are connected in the channels of base sides 30, 32 so that the length of the riser arms 66, 68 places the front bracket 48 of the elevator means 34 approximately over the front 26 of base 24 in the lowered position of the elevator means 34. This placement of the riser arms 66, 68 minimizes the obstruction the base 24 presents to a person sitting in the seating structure 22 in the lowered position. This placement of the front riser arms 66, 68 also minimizes the obstruction the base 24 presents to a person entering or exiting the elevated seating structure 22, since the rearward motion of the elevator means 34 and seating structure 22 due to the rearward pivoting of the riser arms 66,68, 70,72 is offset by the forward tilting of the elevator means 34 and seating structure 22 in the elevated position. The compensating effect of the tilt is amplified by the height of the seating surface 47 of seating structure 22 above the front bracket 48. The positioning of the riser arms 66, 68, 70, 72 should be coordinated with the length of the riser arms, the length of lifting arm 94 and the height of the seating structure 22 to provide a lift apparatus 20 and seating structure 22 that are comfortable to enter, exit, and occupy. These sizing considerations can be accomodated using simple trigonometry.

Another important consideration in determining the placement and length of riser arms 66, 68, 70, 72 and lifting arm 94, as well as the angle of tilt of the elevator means 34 and the height of the seating structure 22 is their effect on the center of gravity of the combined lift apparatus 20, seating structure 22 and occupant. The center of gravity should remain positioned so that the lift apparatus 20 is stable in all elevations. In the preferred embodiment of FIGS. 7–10, the riser arms 66, 68, 70, 72 and elevator means 34 pivot rearward to shift the center of gravity rearward as the elevator means 34 and seating structure 22 are elevated. This rearward motion is utilized to compensate for the forward movement of the center of gravity created by the tilting of the elevator means 34 and seating structure 22 as they are elevated.

The prototype lift apparatus 20 of FIGS. 1–6 utilizes a reversible electric motor 100 as the power source means 92 with an Acme threaded shaft to drive the ram 86. The electric motor 100 is controlled by control means 46, which is an electric switch (also designated 46) connected into the power wiring 102 to the motor 100. The switch 46 can stop or start the movement of the elevator means 34 in either direction, up or down, at any point in the range of travel of the elevator means 34. The motor 100 also serves as a brake mechanism, that is, when switch 46 is deactivated the motor is dead and, together with the Acme threaded shaft, locks the slide 82 and lifting arm 94 and therefore the elevator means 34 and seating structure 22 into the elevation at which the switch was deactivated.

Figure 11:
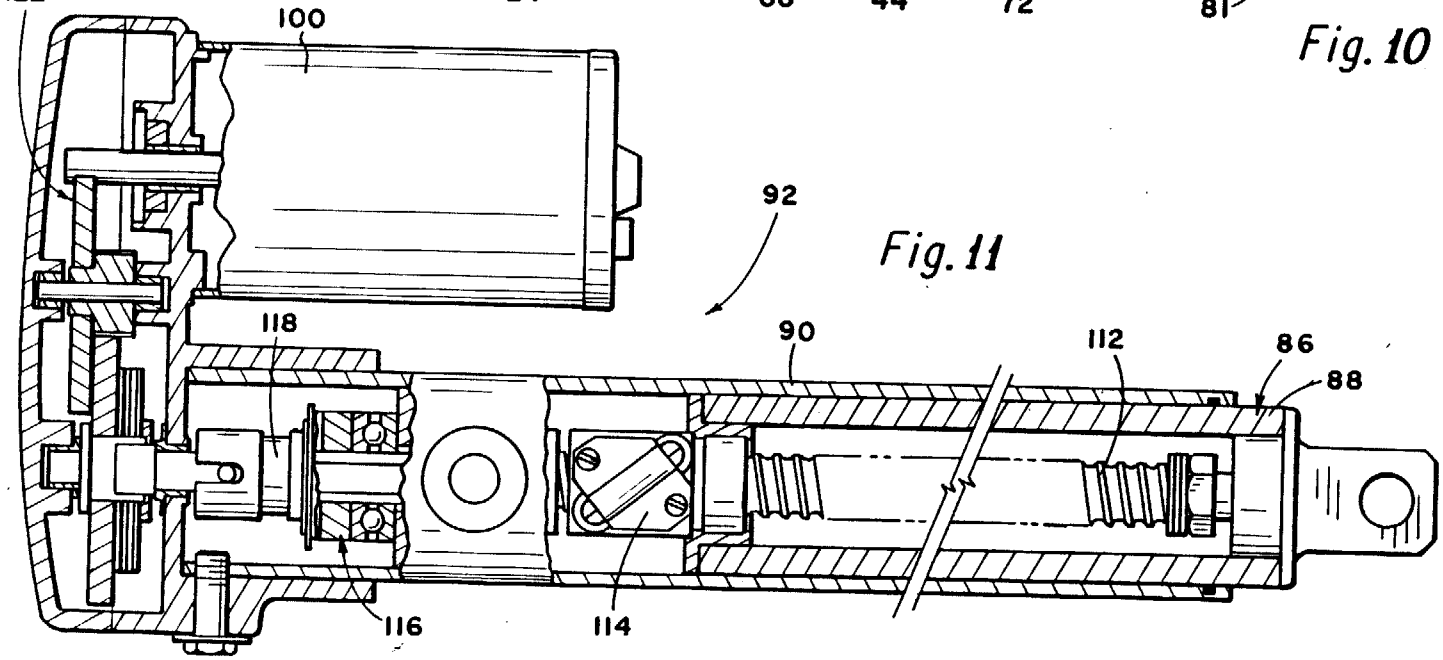
FIG. 11 is a sectional view of an embodiment of the power source means of the present invention.

The more preferred embodiment of FIGS. 7–11 utilizes a linear actuator as the power source means 92. The linear actuator, also designated 92 and best seen in FIG. 11 is electrically powered, and may be adapted to use any commercially available source of electrical power, such as 220 volts AC, 110 volts AC, as well as direct current (DC). In the more preferred embodiment, an electrical transformer (not illustrated) is used to convert the commercially available electrical power (normally 110 volts AC) to 36 volts DC. 36 volts DC is chosen to operate the lift apparatus as a safety factor, since it is generally recognized that 48 volts (AC or DC) is the lowest voltage at which electrical shock can be experienced. Preferably, the electrical transformer is located remotely from the lift apparatus 20 and near the power source to place as much distance as possible between the higher voltage power source and the lift apparatus 20.

The linear actuator 92 of FIG. 11 includes threaded shaft 112 and reversible electric motor 100. The motor 100 is connected to the threaded shaft 112 for rotating the shaft 112 and thereby extending and retracting the ram 86. In the preferred embodiment, referring to the example of FIG. 11, the second end 90 of ram 86 is an outer tube, also designated 90, which encases the threaded shaft 112 and has one end connected to the motor 100. The first end 88 of ram 86 includes an inner tube, also designated 88, which is telescopingly engaged with the outer tube 90 and which is threadingly engaged with the threaded shaft 112 so that as the shaft 112 is rotated by motor 100 the inner tube 88 telescopingly extends from or retracts into outer tube 90. Preferably, the outer tube 90 is securely and non-rotatingly fastened to the motor 100 and elevator means 34, such as by welding, mechanical fasteners, etc. The inner tube 88 is pivotably and non-rotatably fastened to the slide 84. The inside of inner tube 88 is at least partially threaded and as the threaded shaft 112 rotates, the engagement between the shaft 112 and inner tube 88 causes the inner tube 88 and slide 84 to extend or retract relative to the shaft 112 and outer tube. Preferably, a threaded nut 114 is securely fastened within the inner tube 88 and the nut 114 engages the threaded shaft 112. More preferably, the threaded shaft 112 and nut 114 are a ball screw assembly in order to reduce friction and increase the efficiency of the power source means or linear actuator 92.

Referring to the example of FIG. 11 in the preferred embodiment, the inner and outer tubes 88, 90 are sized so that the internal diameter of each of the tubes 88, 90 is less than twice the diameter of the threaded shaft 112. This is provided as a safety feature. Since the shaft 112 is held in compression by the weight of the elevator means 34 and seating structure 22, i.e., the inner tube 88 and slide 84 must extend relative to the outer tube 90 to elevate the elevator means 34, if the shaft 112 should break, which is common with some types of threaded shafts, the pieces of the broken shaft 112 are forced together and can not pass within the tubes 88, 90 and the elevator means 34 and seating structure 22 can not fall.

Preferably, the inner and outer tubes 88, 90 are sealed at their outer ends as well as at their telescopic joint to prevent dust, dirt and other foreign matter from accumulating on the threaded shaft 112 and adversely affecting the operation and useful life of the linear actuator or power source means 92. The placement of the linear actuator 92 on the elevator means 34 also may contribute to shielding the threaded shaft 112, particularly if the shaft 112 is not encased in the tubing, since such placement locates the shaft 112 directly beneath the seating structure 22 and the elevating and lowering of the shaft 112 with the elevator means 34 prevents the accumulation of larger debris and articles on the shaft 112 and actuator 92.

Referring to example FIG. 11 in the preferred embodiment, the linear actuator 92 includes brake means 116 having an input side 118 connected to motor 100 and an output side connected to threaded shaft 112. The brake means 116 prevents rotation of shaft 112 unless a rotary force is applied to the input side the lifting apparatus 20 in position anytime power is lost, e.g., if a fuse is blown, wire is broken, transformer fails, etc. or if there is a mechanical failure in the connection between the input side 118 of the brake means 116 and the motor 100. The brake means 116 only releases if rotary force is applied to the input side 118. The brake means 116 should be sized to hold three to four times the maximum actuator load.

Referring again to FIG. 11 in the more preferred embodiment, double-reduction gearing, generally designated 122, is used to connect the motor 100 to the brake means 116. The gearing is used to slow the speed at which the elevator means 34 and seating structure 22 are elevated and lowered. The gearing is selected, such that it takes approximately thirty seconds to fully elevate or to fully lower the elevator means 34. This slow, steady movement gives the occupant time to brace and position themselves and their legs as the lift apparatus 20 raises or lowers seating structure 22.

In the preferred embodiment of FIG. 11, the linear actuator 92 is commercially available complete with the ball screw assembly, brake means 116, and double-reduction gearing 122 as well as other desirable features such as limit switches, a slip clutch, 36 VDC motor, 12-inch stroke, etc. One such commercially available linear actuator is manufactured by Thomson Saginaw and is currently identified as Model No. 7821221.

As discussed supra, the motor 100 and the motion of the lift apparatus 20 is controlled by control means 46, which is preferably a hand-held double-pole double-throw momentary rocker switch and is connected into the power wiring 102 to motor 110. The switch 46 can stop or start the movement of the elevator means 34 in either direction, up or down, at any point in the range of travel between and including the fully elevated and fully lowered positions. The control means 46 may be mounted on a stand, as exemplified in FIG. 1, may be left free, or means may be provided to attach the control means 46 to the seating structure, e.g., a velcro strip, snap, or other detachable reusable fastener may be attached to the control means 46 and seating structure 22 as desired by the user. The control means 46 should be accessible to and operable by an occupant of the seating structure 22.

In the more preferred embodiment, referring to the example of FIGS. 7-10, the attachment means 48, 50, discussed supra, are modified to more securely fasten the seating structure 22 to the elevator means 34. Front bracket 48 is located at the front edge 36 of the elevator means 34 in order to allow the seating structure 22 to be positioned as far forward on the lift apparatus 20 as possible and therefore to allow entry or access to the seating structure 22 with as little obstruction by the lift apparatus 20 as possible. Rear bracket 50 slides in slots 56, 58 in order to adjust to accommodate various sizes of furniture or seating structures 22. Referring to example FIG. 9, slip nuts 60, 62 are provided to secure the rear bracket 50 in position and thereby to secure the seating structure 22 to the lift apparatus 20 once the rear bracket has been adjusted to fit the seating structure 22. The slip nuts 60, 62 may be replaced with spring loaded pins, mechanical pins, bolts, or equivalent mechanical fasteners. In the preferred embodiment, the front and rear brackets 48, 50 are L-shaped in transverse cross-section.

Referring to the example of FIG. 8, it can be seen that approximately the upper one-third of the vertical portion 124 of the rear bracket 50 is bent toward the inside of the lift apparatus 20 and therefore towards the seating structure 22 in order to engage the legs or understructure of the seating structure 22. Turnbuckles 126, 128 are provided to assist in restraining the seating structure 22 in the three major axis directions. Sideways or lateral movement is prevented by centering the seating structure 22 on the elevator means 34 and then hooking the turnbuckle ends in the holes 130 provided in the front and rear brackets 48, 50. The turnbuckles 126, 128 should be connected to the holes 130 nearest to the sides of the seating structure 22. Fore and aft or normal movement is prevented by tightening the turnbuckles sufficiently to snugly engage the seating structure 22 between the front and rear brackets 48, 50, i.e., as the turnbuckles 126, 128 are tightened, the rear bracket 50 is pulled into tighter contact with the legs or understructure of seating structure 22. Vertical movement of the seating structure 22 is also prevented by tightening the turnbuckles 126, 128 and thereby tightening the front and rear brackets 48, 50 against the seating structure 22. To enhance the ability of the turnbuckles 126, 128 and front and rear brackets 48, 50 to retain the seating structure 22 on the elevator means 34, pieces of adhesive-coated rubber strips 132 may be placed between each leg, foot, or point of contact between the seating structure 22 and the front and rear brackets 48, 50. The adhesive qualities of the strips 132 aids in retaining the seating structure 22 between the front and rear brackets 48, 50. The flexible, firm texture of the rubber strips 132 distributes the pressure of the front and rear brackets 48, 50 on the seating structure 22 and enhances the frictional grip between the seating structure 22 and the front and rear brackets 48, 50. The rubber strips 132 also eliminate any squeaking which may be created by contact between the seating structure 22 and the front and rear brackets 48, 50.

In the more preferred embodiment of FIGS. 7–10 the base 24 and elevator means 34 are made of cold-rolled strip mild steel. As mentioned supra, the base 34 and elevator means 34 are channel shaped in transverse cross section, the channel having a one-and one-half inch web and one inch flanges. The outside dimensions of the base 24 and elevator means 34 are thirty inches in width by thirty inches in length. The preferred riser arms 66, 68, 70, 72 and lifting arm 94 are cold formed square tubing. In the preferred embodiment of FIGS. 7–10 the front riser arm 66, 68, are approximately twelve inches in length, the rear riser arms 70, 72 are approximately twenty-one inches in length, and the lifting arm 94 is approximately eleven inches in length. As mentioned above, it is intended to be understood that the dimensions of the lift apparatus 20 may be adjusted to accomodate the size of a particular seating structure 22 or the needs and desires of a specific user. The lift apparatus 20 may be made of any material having sufficient rigidity and strength to support a seating structure 22 and occupant.

While the invention has been described with a certain degree of particularity, it is manifest that many changes may be made in details of construction and the arrangement of components without departing from the spirit and scope of this disclosure. It is intended to be understood that the invention is not limited to the embodiments set forth herein for purposes of exemplification, but is to be limited only by the scope of the attached claim or claims including the full range of equivalency to which each element thereof is entitled.

What is claimed is:

1. An apparatus for elevating and lowering a freestanding seating structure, such as a house chair, recliner, or sofa, the freestanding seating structure having an understructure or legs for contacting a generally planar surface, such as a floor, the understructure supporting the seating surface of the freestanding seating structure in a position spaced away from the planar surface, comprising:

a base having a front, a rear, and two sides, the front, the rear, and the sides of the base generally defining a plane of the base;

elevator means for releasably receiving, supporting, elevating, and lowering the freestanding seating structure, the elevator means having a front, a rear, and two sides oriented in correspondence with the like-named features of the base;

power means, connected between the base and the elevator means, for providing power and for supportingly moving the elevator means between a lowered position and an elevated position relative to the base;

control means for controlling the power means and for controlling the position of the elevator means relative to the base; and riser arm means, having one end pivotally engaged with the base and the other end pivotally engaged with the elevator means, for structurally supporting and stabilizing the elevator means and for distributing the forces of the elevator means on the base, the riser arm means pivoting to form a smaller angle with the plane of the base as the elevator means is lowered, and the riser arm means pivoting to form a larger angle with the plane of the base as the elevator means is elevated;

the power means comprising:

a slideway secured to the elevator means;

a slide slidingly engaging the slideway;

a ram having a first end pivotally engaged with the slide and having a second end;

power source means, engaged with the second end of the ram, for drivingly extending and retracting the ram and slide; and a lifting arm, having a first end pivotally engaged with the base and a second end pivotally engaged with the slide, the lifting arm pivoting to form a larger angle with the base as the ram and slide are extended thereby elevating the elevator means, and the lifting arm pivoting to form a smaller angle with the base as the ram and slide are retracted thereby lowering the elevator means.

2. An apparatus for elevating and lowering a freestanding seating structure, such as a house chair, recliner, or sofa, the freestanding seating structure having an understructure or legs for contacting a generally planar surface, such as a floor, the understructure supporting the seating surface of the freestanding seating structure in a position spaced away from the planar surface, comprising:

a base having a front, a rear, and two sides which generally define a plane of the base;

an elevator means for releasably receiving, supporting, elevating, and lowering the freestanding seating structure without addition to or modification of the freestanding seating structure, the elevator means having a front, a rear, and two sides oriented in correspondence with the like-named features of the base;

power means, connected between the base and the elevator means, for providing power and for supportingly moving the elevator means between a lowered position and an elevated position relative to the base;

control means for controlling the power means and for controlling the position of the elevator means relative to the base, the control means being accessible to and operable by an occupant of the seating structure; and riser arm means, having one end pivotally engaged with the base and the other end pivotally engaged with the elevator means, for structurally supporting and stabilizing the elevator means and for distributing the forces of the elevator means on the base; and wherein the riser arm means pivots to form a smaller angle with the plane of the base as the elevator means is lowered and the riser arm means pivots to form a larger angle with the plane of the base as the elevator means is elevated; and wherein the riser arm means is further defined as pivoting towards the rear of the elevator means and the rear of the base as the elevator means is elevated, thereby moving the elevator means towards the rear of the base as the elevator means is elevated.

3. The apparatus of claim 1:

wherein the longitudinally axial plane of the lifting arm, the longitudinally axial plane of the riser arm means, and the plane of the base form a triangle.

4. The apparatus of claim 1 in which the power source means comprises:

a threaded shaft; and a motor connected to the threaded shaft for rotating the threaded shaft; and in which the ram comprises:

an outer tube encasing the threaded shaft and having one end connected to the motor; and an inner tube, telescopingly engaged with the outer tube and threadingly engaged with the threaded shaft.

5. The apparatus of claim 4:

wherein the internal diameter of each of the inner and outer tubes is smaller than twice the diameter of the threaded shaft.

6. The apparatus of claim 4 in which the power means further comprises:

brake means, having an input side connected to the motor and an output side connected to the threaded shaft, for allowing rotation of the threaded shaft only "when a rotary force is applied to the input side of the brake means.

7. An apparatus for elevating and lowering a freestanding seating stricture, such as a house chair, recliner, or sofa, comprising:

a base having a front, a rear, and two sides which generally define a plane of the base;

an elevator means for releasably receiving, supporting, elevating, and lowering the freestanding seating structure, the elevator means having a front, a rear, and two sides oriented in correspondence with the like-named features of the base;

power means, connected between the base and the elevator means, for providing power and for supportingly moving the elevator means between a lowered position and an elevated position relative to the base;

control means for controlling the power means and for controlling the position of the elevator means relative to the base;

riser arm means, having one end pivotally engaged with the base and the other end pivotally engaged with the elevator means, for structurally supporting and stabilizing the elevator means and for distributing the forces of the elevator means on the base, the riser arm means pivoting to form a smaller angle with the plane of the base as the elevator means is lowered, and the riser arm means pivoting to form a larger angle with the plane of the base as the elevator means is elevated;

the power means comprising:

a slideway secured to the elevator means;

a slide slidingly engaging the slideway;

a ram having a first end pivotally engaged with the slide and having a second end;

a power source means, engaged with the second end of the ram, for drivingly extending and retracting the ram and slide; and a lifting arm, having a first end pivotally engaged with the base and a second end pivotally engaged with the slide, the lifting arm pivoting to form a larger angle with the base as the ram and slide are extended thereby elevating the elevator means, and the lifting arm pivoting to form a smaller angle with the base as the ram and slide are retracted thereby lowering the elevator means.

* * * * *

UNITED STATES PATENT AND TRADEMARK OFFICE

CERTIFICATE OF CORRECTION

PATENT NO. : 4,850,645

DATED : July 25, 1989

INVENTOR(S) : Foy Crockett

It is certified that error appears in the above-identified patent and that said Letters Patent is hereby corrected as shown below:

IN THE ABSTRACT:

Line 14, change "the" to --and--.

IN THE DETAILED DESCRIPTION OF THE PREFERRED EMBODIMENTS:

Column 5, line 11, change "comprise'a" to --comprise: a--.

IN THE CLAIMS:

Claim 6, column 12, line 1, delete " " ".

Signed and Sealed this

Thirtieth Day of January, 1990

*Attest:*

JEFFREY M. SAMUELS

*Attesting Officer*

*Acting Commissioner of Patents and Trademarks*